US011241886B2

(12) United States Patent
Omori

(10) Patent No.: US 11,241,886 B2
(45) Date of Patent: Feb. 8, 2022

(54) INKJET RECORDING DEVICE AND PROGRAM

(71) Applicant: KONICA MINOLTA, INC., Tokyo (JP)

(72) Inventor: Yuichi Omori, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/738,407

(22) Filed: Jan. 9, 2020

(65) Prior Publication Data

US 2020/0223222 A1 Jul. 16, 2020

(30) Foreign Application Priority Data

Jan. 11, 2019 (JP) ..... JP2019-003676

(51) Int. Cl.

| | |
|---|---|
| ***B41J 2/205*** | (2006.01) |
| ***B41J 11/00*** | (2006.01) |
| ***B41J 2/045*** | (2006.01) |
| *B41J 25/00* | (2006.01) |

(52) U.S. Cl.

CPC ..... *B41J 2/2054* (2013.01); *B41J 2/04508* (2013.01); *B41J 2/04586* (2013.01); *B41J 11/0005* (2013.01); *B41J 2025/008* (2013.01); *B41J 2203/011* (2020.08)

(58) Field of Classification Search

CPC .. B41J 2/2054; B41J 11/0005; B41J 2/04586; B41J 2/04508; B41J 2025/008; B41J 2203/011

See application file for complete search history.

(56) References Cited

U.S. PATENT DOCUMENTS 8,941,876 B2 * 1/2015 Tamagawa ..... B41J 2/17566 358/1.2
9,193,177 B1 * 11/2015 LeFevre ..... B41J 11/0015

FOREIGN PATENT DOCUMENTS

JP 2009119713 A 6/2009

* cited by examiner

*Primary Examiner* — Geoffrey S Mruk
(74) *Attorney, Agent, or Firm* — Cantor Colburn LLP

(57) ABSTRACT

An inkjet recording device includes: an inkjet head that includes a nozzle for discharging ink on a recording material, and forms an image by discharging the ink from the nozzle on the recording material based on image data; and a hardware processor that performs image processing of the image data, wherein the hardware processor calculates a difference in ink adhesion amount between a target region and an adjacent target region adjacent to the target region in the image data, determines whether the difference in the ink adhesion amount exceeds a threshold based on a calculation result of the hardware processor, and performs a responding process for occurrence of a wrinkle on the recording material based on a determination result of the hardware processor.

10 Claims, 11 Drawing Sheets

FIG. 11

| PRINTING RATE (%) | | ADJACENT TARGET REGION | | | | | |
|---|---|---|---|---|---|---|---|
| | | 0 | 10 | 30 | 50 | 70 | 100 |
| TARGET REGION | 0 | 0.0mm | 0.3mm | 0.6mm | 1.0mm | 1.2mm | 1.2mm |
| | 10 | 0.3mm | 0.0mm | 0.2mm | 0.6mm | 1.1mm | 1.2mm |
| | 30 | 0.6mm | 0.2mm | 0.2mm | 0.3mm | 0.5mm | 1.1mm |
| | 50 | 1.0mm | 0.6mm | 0.3mm | 0.3mm | 0.3mm | 0.3mm |
| | 70 | 1.2mm | 1.1mm | 0.5mm | 0.3mm | 0.2mm | 0.3mm |
| | 100 | 1.2mm | 1.2mm | 1.1mm | 0.3mm | 0.3mm | 0.2mm |

FIG. 12

| PRINTING RATE (%) | | ADJACENT TARGET REGION | | | | | |
|---|---|---|---|---|---|---|---|
| | | 0 | 10 | 30 | 50 | 70 | 100 |
| TARGET REGION | 0 | 0.0mm | 0.1mm | 0.1mm | 0.2mm | 0.15mm | 0.4mm |
| | 10 | 0.1mm | 0.0mm | 0.0mm | 0.1mm | 0.1mm | 0.4mm |
| | 30 | 0.1mm | 0.0mm | 0.0mm | 0.0mm | 0.1mm | 0.3mm |
| | 50 | 0.2mm | 0.1mm | 0.0mm | 0.0mm | 0.1mm | 0.1mm |
| | 70 | 0.15mm | 0.1mm | 0.1mm | 0.1mm | 0.1mm | 0.1mm |
| | 100 | 0.4mm | 0.4mm | 0.3mm | 0.1mm | 0.1mm | 0.1mm |

INKJET RECORDING DEVICE AND PROGRAM

CROSS REFERENCE TO RELATED APPLICATIONS

The present invention claims priority under 35 U.S.C. § 119 to Japanese patent Application No. 2019-003676, filed on Jan. 11, 2019, is incorporated herein by reference in its entirety.

BACKGROUND

Technological Field

The present invention relates to an inkjet recording device using an inkjet recording method, and a program.

Description of the Related Art

In the inkjet recording device, it is known that a phenomenon in which a recording material expands and contracts by absorbing an ink solvent, that is, a so-called cockling phenomenon occurs (refer to, for example, JP 2009-119713 A).

Cockling occurs according to a condition such as an amount of ink applied to the recording material (ink application amount) and an elapsed time from an image is recorded. As the amount of ink applied increases, an amount of ink absorbed in the recording material increases, so that the expansion and contraction of the recording material increases. Also, the longer the time elapsed from the image is recorded, the more the ink is absorbed in the recording material and then the ink is dried, so that the expansion and contraction of the recording material increases.

In this manner, since an amount of occurrence of cockling depends on an image condition and an environmental condition at the time of image recording, it is difficult to specify before the image formation. Therefore, in JP 2009-119713 A mentioned above, a cockling detecting pattern is formed on the recording material, and a height of the cockling occurring in the cockling detecting pattern is detected. Based on the detected cockling height, a position in a height direction of a recording head at the time of image formation is set.

However, the inventor of the present invention obtains a knowledge that there might be a case where not only the cockling but also a wrinkle occurs on the recording medium at a boundary between regions in a case where a difference in ink adhesion amount between adjacent regions is large in an inkjet recording method image formation. Such wrinkle occurring at the boundary between the adjacent regions has a mechanism different from that in the occurrence of the cockling in a printing unit, so that this cannot be predicted by a detecting method using the cockling detecting pattern described above.

SUMMARY

In order to solve the above-described problem, the present invention provides an inkjet recording device and a program capable of predicting the occurrence of the wrinkle.

To achieve the abovementioned object, according to an aspect of the present invention, an inkjet recording device reflecting one aspect of the present invention comprises: an inkjet head that includes a nozzle for discharging ink on a recording material, and forms an image by discharging the ink from the nozzle on the recording material based on image data; and a hardware processor that performs image processing of the image data, wherein the hardware processor calculates a difference in ink adhesion amount between a target region and an adjacent target region adjacent to the target region in the image data, determines whether the difference in the ink adhesion amount exceeds a threshold based on a calculation result of the hardware processor, and performs a responding process for occurrence of a wrinkle on the recording material based on a determination result of the hardware processor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 11 is a table illustrating a height of the wrinkle occurring by the difference in the ink adhesion amount;

FIG. 12 is a table illustrating a height of the wrinkle occurring by the difference in the ink adhesion amount.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
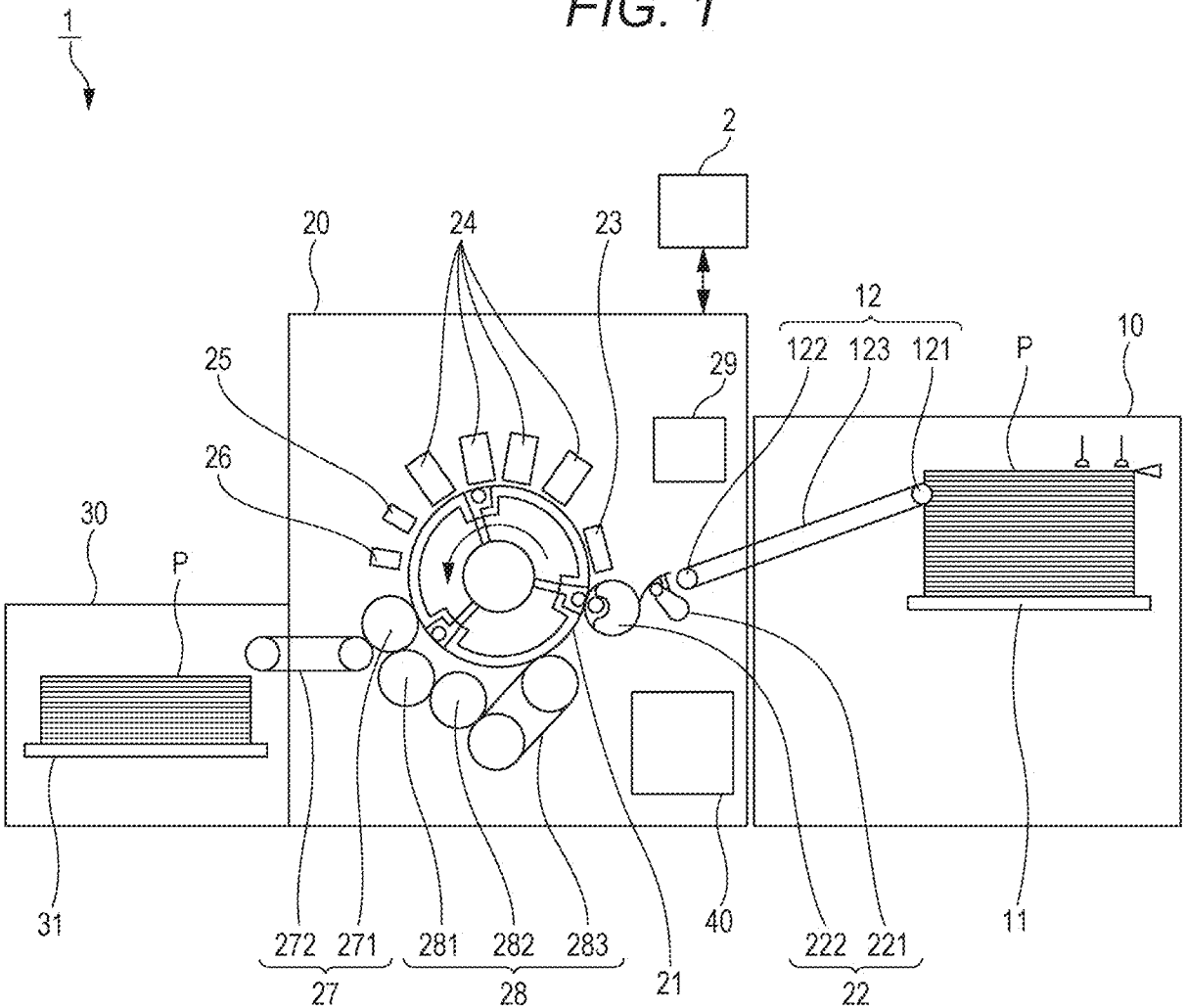
FIG. 1 is a schematic configuration diagram illustrating an overall configuration of an inkjet recording device.

FIG. 1 illustrates a configuration of an inkjet recording device of this embodiment. FIG. 1 is a schematic configuration diagram illustrating an overall configuration of the inkjet recording device.

An inkjet recording device 1 illustrated in FIG. 1 discharges ink from a nozzle provided on an inkjet head to form (record) an image on a recording material. The inkjet recording device 1 is a color inkjet recording device which superposes inks of four colors of yellow (Y), magenta (M), cyan (C), and black (Bk).

The inkjet recording device 1 includes a paper feeder 10, an image forming unit 20, a paper discharger 30, a humidity measuring unit 29, and a controller 40. The inkjet recording device 1 forms image data input from a terminal device 2 (refer to FIG. 3) on a recording material P.

The paper feeder 10 includes a paper feed tray 11 and a recording material supplier 12. The paper feed tray 11 is a plate-shaped member provided so that the recording material P as an example of the recording material may be placed thereon. The paper feed tray 11 is provided so as to be movable in a vertical direction according to the number of recording materials P placed thereon. The uppermost recording material P in the vertical direction out of a plurality of recording materials P placed on the paper feed tray 11 is held in a position where this is conveyed by the recording material supplier 12.

The recording material supplier 12 includes a plurality of (in this example, two) rollers 121 and 122 and a conveyor belt 123. The conveyor belt 123 is formed into an endless shape obtained by connecting both ends thereof in a longitudinal direction. The conveyor belt 123 is stretched around the rollers 121 and 122. When one of the rollers 121 and 122 is rotationally driven, the conveyor belt 123 circulates to move between the two rollers 121 and 122. As a result, the recording material P placed on the conveyor belt 123 is conveyed.

The recording material supplier 12 also includes a driver not illustrated which rotationally drives the rollers 121 and 122 and a supplying device which transfers the uppermost recording material P placed on the paper feed tray 11 to the conveyor belt 123. The recording material supplier 12 conveys the recording material P placed on the conveyor belt 123 toward the image forming unit 20 and feeds the same to the image forming unit 20.

The image forming unit 20 includes an image forming drum 21, a transfer unit 22, a heater 23, a head unit 24, a fixing unit 25, an image reader 26, a recording material discharger 27, and a recording material reversing unit 28.

The image forming drum 21 is formed into a cylindrical shape. The image forming drum 21 is rotated counterclockwise by a driving motor not illustrated. The recording material P fed from the paper feeder 10 is carried on an outer peripheral surface of the image forming drum 21. The image forming drum 21 is rotationally driven to convey the recording material P toward the paper discharger 30. On the outer peripheral surface of the image forming drum 21, the heater 23, the head unit 24, the fixing unit 25, and the image reader 26 are arranged so as to be opposed thereto.

The transfer unit 22 is provided in a position interposed between the recording material supplier 12 of the paper feeder 10 and the image forming drum 21. The transfer unit 22 includes a claw 221, a cylindrical transfer drum 222 and the like. The claw 221 carries one end of the recording material P conveyed by the recording material supplier 12. The transfer drum 222 guides the recording material P carried by the claw 221 toward the image forming drum 21. As a result, the recording material P is transferred from the recording material supplier 12 to the outer peripheral surface of the image forming drum 21 via the transfer unit 22.

On a downstream side in a conveyance direction of the recording material P of the transfer drum 222, the heater 23 is arranged. The heater 23 includes, for example, a heating wire and the like and generates heat in response to energization. Under control of the controller 40, the heater 23 generates heat so that temperature of the recording material P carried by the image forming drum 21 and passing through the vicinity of the heater 23 reaches predetermined temperature.

A temperature sensor not illustrated is provided in the vicinity of the heater 23. Then, the temperature sensor detects the temperature in the vicinity of the heater 23. The controller 40 controls the temperature of the heater 23 based on temperature information detected by the temperature sensor.

The head unit 24 is provided on a downstream side in the conveyance direction of the recording material P of the heater 23. Four head units 24 are provided corresponding to yellow (Y), magenta (M), cyan (C), and black (Bk). The four head units 24 are arranged in the order of yellow, magenta, cyan, and black from an upstream side in the conveyance direction of the recording material P.

The head unit 24 is set to have a length (width) which covers an entire recording material P in a direction (width direction) orthogonal to the conveyance direction of the recording material P. That is, the inkjet recording device 1 is a one pass-system line head-type inkjet recording device. The four head units 24 have the same configuration except that the colors of the discharged ink are different.

Figure 2:
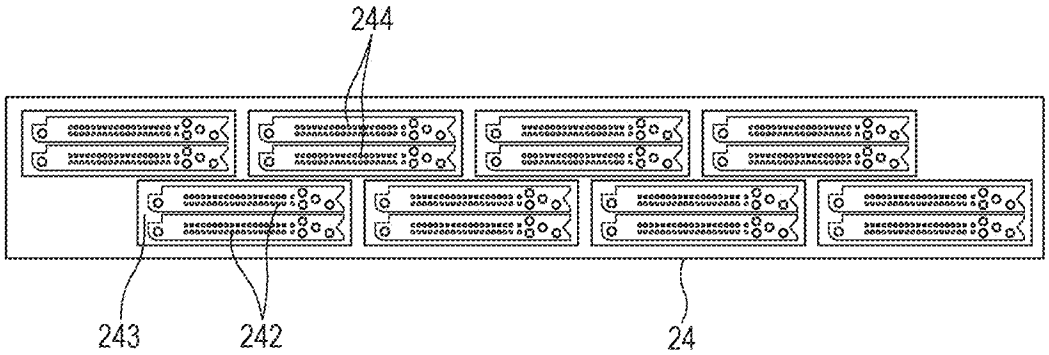
FIG. 2 is a plan view illustrating a configuration of a head unit as seen from a recording material side.

FIG. 2 is a plan view illustrating a state in which the head unit 24 is seen from a recording material side.

As illustrated in FIG. 2, the head unit 24 includes a plurality of (in this example, 16) inkjet heads 242. Two inkjet heads 242 form one set to be one inkjet module 243. Therefore, eight inkjet modules 243 are provided in the head unit 24 of this example.

The eight inkjet modules 243 are arranged in two lines in the conveyance direction of the recording material P. In one line, four inkjet modules 243 are arranged side by side in a direction (width direction) orthogonal to the conveyance direction of the recording material P. The eight inkjet modules 243 are such that the two lines of inkjet modules 243 are arranged alternately in a staggered manner in the conveyance direction of the recording material P.

Note that the number and arrangement of the inkjet modules 243 are not limited to those described above, and six or ten or more inkjet modules 243 may also be arranged.

The inkjet head 242 includes a plurality of nozzles 244. The inkjet head 242 discharges the ink from the nozzle 244 toward the recording material P. As a result, an image is formed on the recording material P carried by the image forming drum 21.

The fixing unit 25 is arranged on a downstream side in the conveyance direction of the four head units 24. As the fixing unit 25, for example, a fluorescent tube which emits ultraviolet light such as a low-pressure mercury lamp is applied. The fixing unit 25 irradiates the recording material P conveyed by the image forming drum 21 with the ultraviolet light, and cures the ink discharged on the recording material P. As a result, the fixing unit 25 fixes the image formed on the recording material P.

The fluorescent tube emitting the ultraviolet light includes a mercury lamp with operating pressure of approximately several hundreds of Pa to 1 MPa, a light source which may be used as a germicidal lamp, a cold cathode tube, an ultraviolet laser light source, a metal halide lamp, a light-emitting diode and the like in addition to the low-pressure mercury lamp. Among them, a light source (for example, the light emitting diode and the like) capable of emitting the ultraviolet light with higher illuminance which consumes less power is more desirable.

Note that the fixing unit 25 is not limited to the unit which emits the ultraviolet light, but may be any unit which emits an energy ray having a property of curing the ink according to a property of the ink; the light source is also replaced depending on a wavelength of the energy ray and the like. The fixing unit 25 is not limited to the unit which emits the light such as the ultraviolet light. The fixing unit includes, for example, a unit which applies heat to the recording material to dry the ink, a unit which applies liquid to allow the ink to cause chemical change, and a unit to which various other methods may be applied.

The image reader 26 is arranged on a downstream side in the conveyance direction of the fixing unit 25. The image reader 26 is formed of an inline sensor in which a plurality of detecting elements is arranged in a direction (width direction) orthogonal to the conveyance direction of the recording material P, and reads the image formed on the recording material P by the head unit 24 and the fixing unit 25. Data of the read image is transmitted to the controller 40. Note that an interval between the detecting elements forming the image reader 26 is set to be wider than an interval between the nozzles 244 of the inkjet head 242. That is, resolution of the image reader 26 is set to be coarser than resolution of the head unit 24.

The recording material discharger 27 and the recording material reversing unit 28 are provided on a downstream side in the conveyance direction of the image reader 26. The recording material discharger 27 conveys the recording material P conveyed by the image forming drum 21 toward the paper discharger 30.

The recording material discharger 27 includes a cylindrical separating drum 271 and a discharge belt 272. The separating drum 271 separates the recording material P carried by the image forming drum 21 from the outer peripheral surface of the image forming drum 21. The separating drum 271 guides the recording material P to the discharge belt 272 or the recording material reversing unit 28.

The separating drum 271 guides the recording material P to the discharge belt 272 in a case where face-up discharge in single-sided image formation is performed. The separating drum 271 guides the recording material P to the recording material reversing unit 28 in a case where face-down discharge in the single-sided image formation and double-sided image formation are performed.

The discharge belt 272 is formed into an endless shape as is the case with the conveyor belt 123 of the recording material supplier 12. The discharge belt 272 is rotatably supported by a plurality of rollers. The discharge belt 272 sends out the recording material P transferred by the separating drum 271 to the paper discharger 30.

The recording material reversing unit 28 includes a plurality of reversing rollers 281 and 282 and a reversing belt 283. in a case where the face-down discharge is performed, the recording material reversing unit 28 front-back reverses the recording material P guided by the separating drum 271 and conveys the same to the recording material discharger 27. As a result, the recording material P is conveyed to the paper discharger 30 in a state in which a surface on which the image is formed by the recording material discharger 27 faces downward in the vertical direction.

In a case where the double-sided image formation is performed, the recording material reversing unit 28 front-back reverses the recording material P guided by the separating drum 271 and conveys the same again to the outer peripheral surface of the image forming drum 21. As a result, the recording material P is conveyed by the image forming drum 21 and passes through the heater 23, the head unit 24, the fixing unit 25, and the image reader 26 again.

The paper discharger 30 stores the recording material P sent out from the image forming unit 20 by the recording material discharger 27. The paper discharger 30 includes a flat paper discharge tray 31. The paper discharger 30 places the recording material P on which the image is formed on the paper discharge tray 31.

The inkjet recording device 1 includes the humidity measuring unit 29 therein. The humidity measuring unit 29 detects humidity inside the inkjet recording device 1, that is, surroundings of the recording material (environment).

Control System of Inkjet Recording Device

Next, a configuration of a control system of the inkjet recording device 1 is described with reference to FIG. 3.

Figure 3:
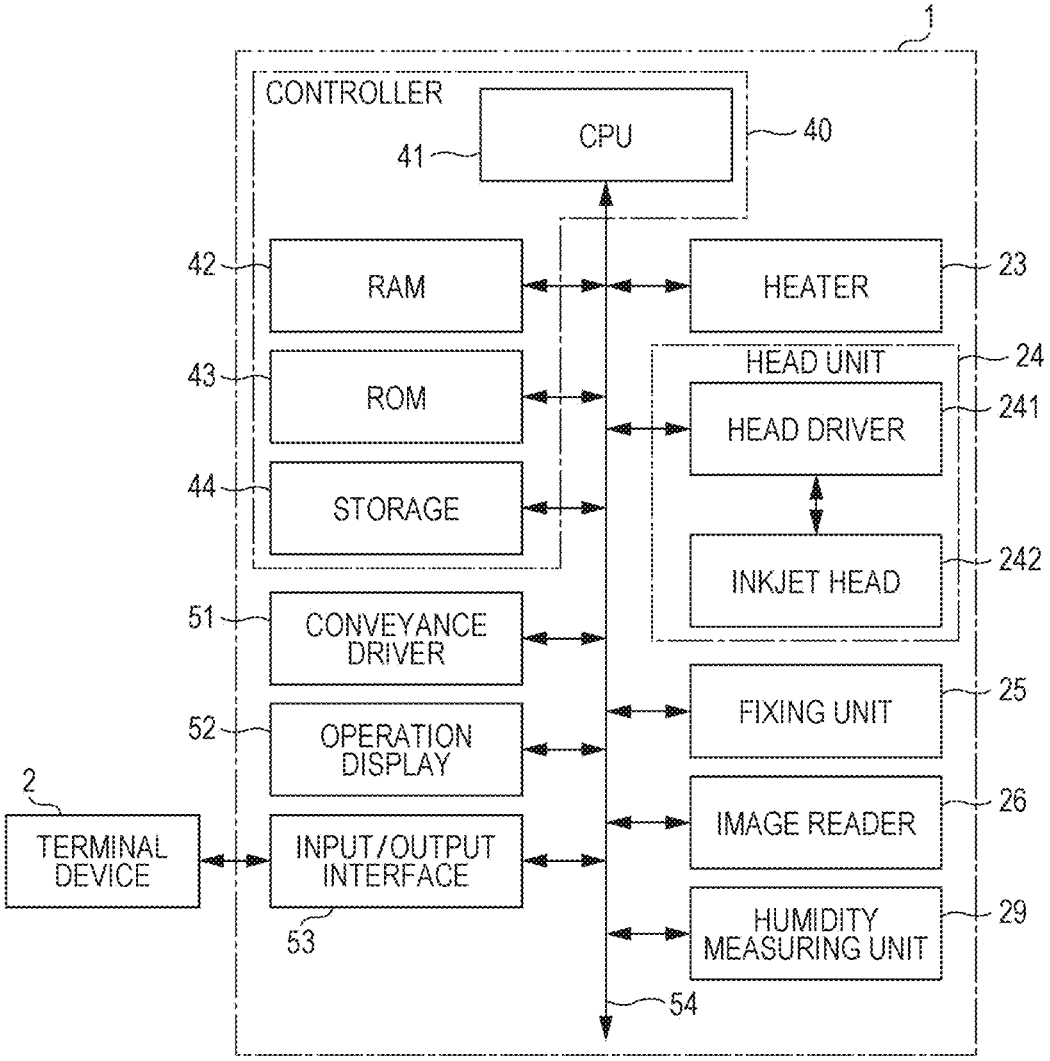
FIG. 3 is a block diagram illustrating a configuration of a control system of the inkjet recording device.

FIG. 3 is a block diagram illustrating the configuration of the control system of the inkjet recording device 1.

As illustrated in FIG. 3, the inkjet recording device 1 is provided with the controller 40. The controller 40 includes a central processing unit (CPU) 41, a random access memory (RAM) 42 used as a working area of the CPU 41, a read only memory (ROM) 43 for storing a program and the like executed by the CPU 41, for example. The controller 40 further includes a storage 44 including a hard disk drive (HDD) and the like as a mass storage device. The storage 44 stores the data of the image read by the image reader 26, a test chart for detecting a discharge defect of the nozzle 244, and information for performing discharge defect detecting operation of the nozzle 244.

The inkjet recording device 1 also includes a conveyance driver 51 which drives a conveyance system such as the image forming drum 21, the recording material discharger 27, and the recording material reversing unit 28, an operation display 52, and an input/output interface 53.

The CPU 41 of the controller 40 is connected to the heater 23, the head unit 24, the fixing unit 25, the image reader 26, the humidity measuring unit 29, the RAM 42, the ROM 43, and the storage 44 via a system bus 54, respectively, to control the entire device. The CPU 41 is also connected to the conveyance driver 51, the operation display 52, and the input/output interface 53 via a system bus 54, respectively.

The operation display 52 is a touch panel formed of a display such as a liquid crystal display (LCD) or an organic electro luminescence display (ELD). The operation display 52 displays an instruction menu for a user, information regarding the discharge detecting operation of the nozzle 244, information regarding the obtained image data and the like. Furthermore, the operation display 52 provided with a plurality of keys serves as an input unit which accepts an input of various instructions, and data such as characters and numbers by key operation of the user.

The input/output interface 53 is connected to the terminal device 2 such as a personal computer (PC) and a facsimile device. The input/output interface 53 receives the image data from the terminal device 2. The input/output interface 53 outputs the received image data to the controller 40. The controller 40 performs image processing on the image data received from the input/output interface 53. The controller 40 performs image processing such as shading correction, image density adjustment, and image compression on the received image data as necessary.

The head unit 24 receives the image data on which the image processing is performed by the controller 40, and forms a predetermined image on the recording material P based on the image data. Specifically, the head unit 24 drives a head driver 241 to discharge the ink from the inkjet head 242 to a predetermined position.

The image formed on the recording material P by the head unit 24 is read by the image reader 26, and the image data is sent to the controller 40. When the discharge defect detecting operation of the nozzle 244 is performed, the controller 40 discriminates the nozzle 244 in which the discharge defect occurs based on the image data sent from the image reader 26. Then, for example, the controller 40 performs correction processing of the head unit 24 by increasing a discharge amount of the ink from the nozzle 244 adjacent to the nozzle 244 in which the discharge defect occurs.

Hardware Configuration of Terminal Device and Inkjet Recording Device

Figure 4:
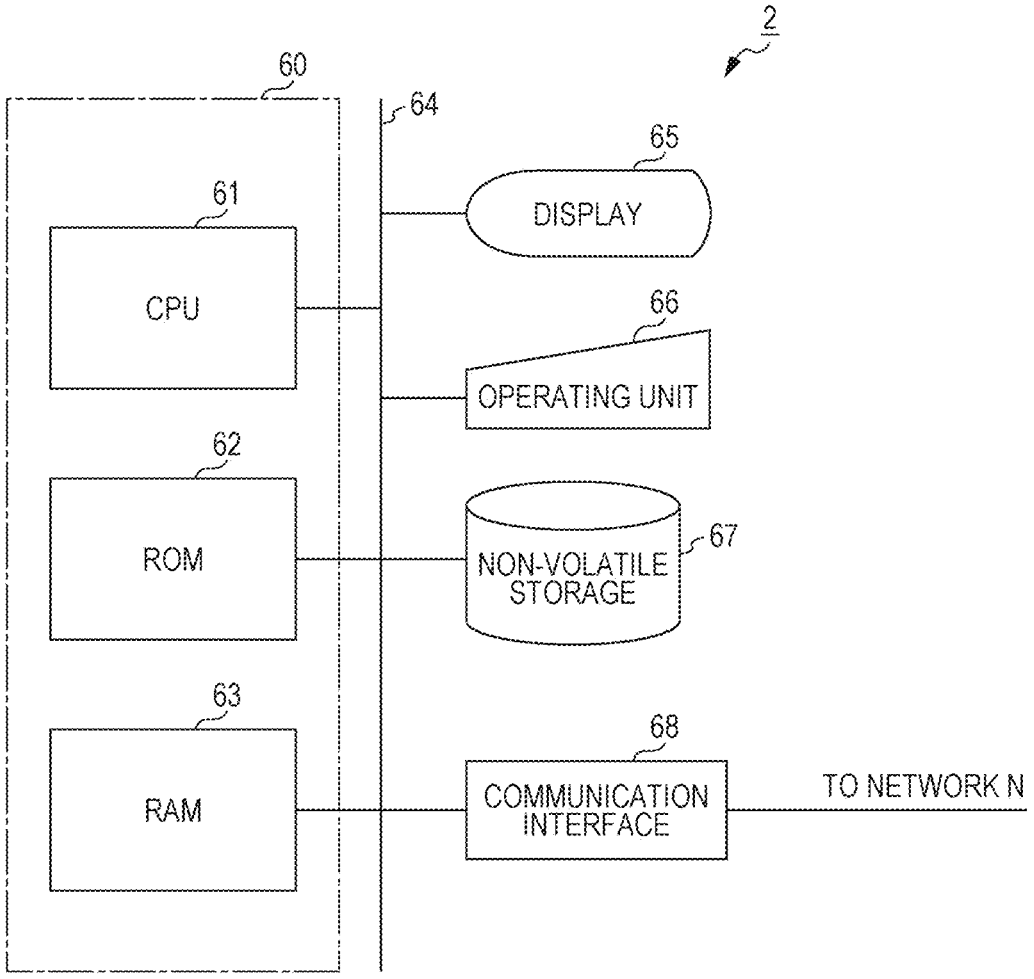
FIG. 4 is a block diagram illustrating a hardware configuration example of the inkjet recording device.

FIG. 4 is a block diagram illustrating a hardware configuration example of the inkjet recording device. Each unit in the device is selected according to a function and a purpose of use of the inkjet recording device. A hardware configuration example of the terminal device 2 connected to the above-described inkjet recording device is herein described.

The terminal device 2 is provided with a controller 60, a display 65, an operating unit 66, a non-volatile storage 67, and a communication interface 68. Each unit in the terminal device 2 is connected via a bus 64.

The controller 60 includes a CPU 61, a ROM 62, and a RAM 63. The controller 60 is used as an example of a computer which controls operation of each unit in the terminal device 2.

The CPU 61 operates a printer driver in response to input operation by the user performed through the operating unit 66, for example, to generate a print job. The CPU 61 is an example of the controller, and reads to execute a program code of software which realizes each function according to this embodiment from the ROM 62 (an example of the recording material). Note that, in place of the CPU 61, another arithmetic device such as a micro processing unit (MPU) may also be used as an arithmetic unit.

The ROM 62 is used as an example of a non-volatile memory, and stores programs, data and the like necessary for the CPU 61 to operate.

The RAM 63 is used as an example of a volatile memory, and temporarily stores information (data) necessary for each process performed by the CPU 61.

The display 65 is a liquid crystal display monitor, for example, and displays a result of processing performed by the controller 60 and the like. For example, a keyboard, a mouse, a touch panel or the like is used as the operating unit 66, and the user may perform predetermined operation to input an instruction.

The non-volatile storage 67 is an example of a recording material, and stores a program for the CPU 61 to control each unit, a program such as an OS, and data. As the nonvolatile storage, for example, a HDD, a solid state drive (SSD), an optical disk, a magneto-optical disk, a CD-ROM, a CD-R, a magnetic tape, a nonvolatile memory card or the like is used.

The communication interface 68 is formed of, for example, a network interface card (NIC), a modem and the like, establishes connection with a communication partner device via a network N such as a LAN, and executes transmission/reception of various data.

Next, a hardware configuration of the inkjet recording device 1 is described. The hardware configuration of the inkjet recording device 1 is similar to the hardware configuration illustrated in FIG. 4. When the CPU 61 of the inkjet recording device 1 receives the print job from the terminal device 2, this detects a type of the recording material P and sets a target region which becomes a target of comparison of an ink adhesion amount with a page to be processed (current page). Then, the CPU 61 calculates an area of the set target region, and calculates a difference in the ink adhesion amount between the target region having a predetermined area or larger area and a target region adjacent thereto (adjacent target region). Furthermore, the CPU 61 determines whether the difference in the ink adhesion amount between the target region and the adjacent target region exceeds a threshold which satisfies a wrinkle occurrence condition. These image determining processes are to be described later in detail.

Functional Configuration of Controller of Inkjet Recording Device

Figure 5:
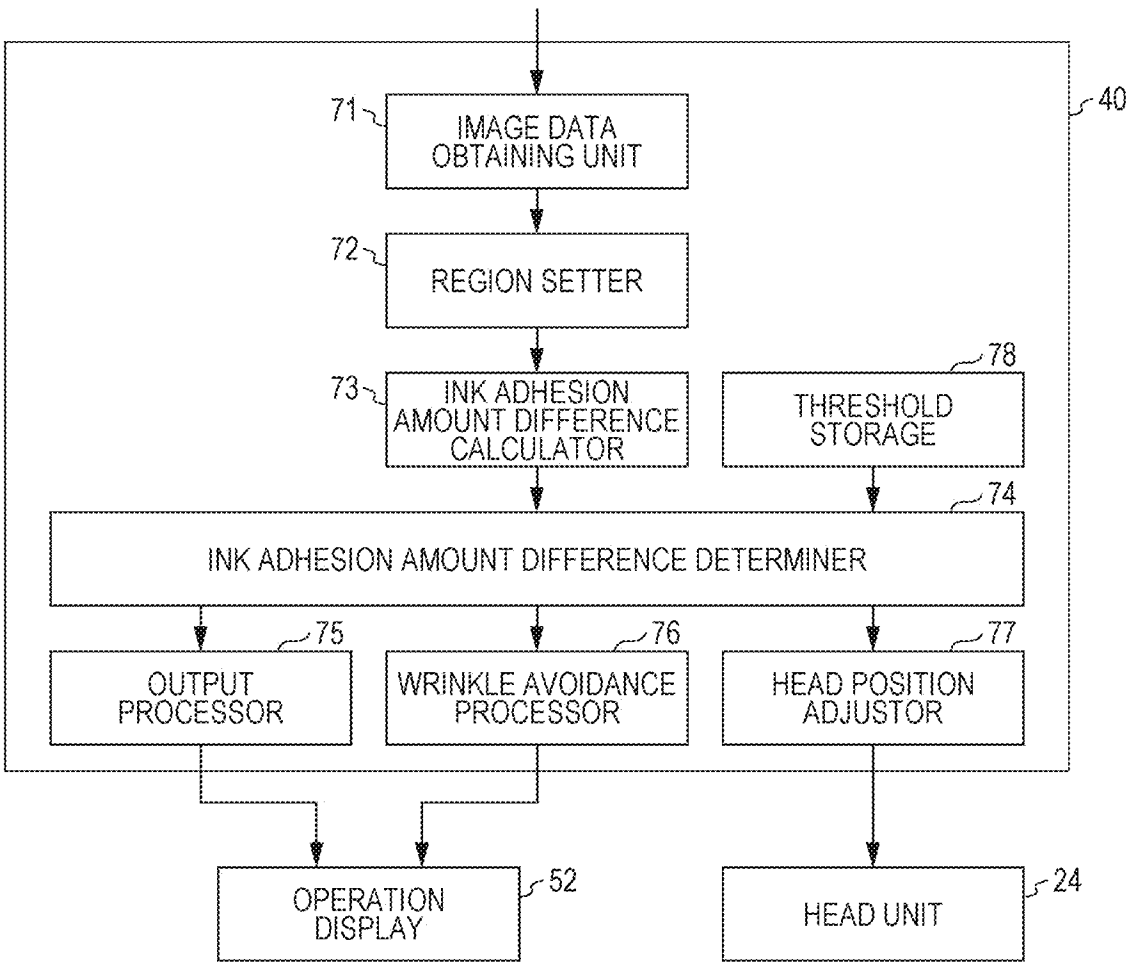
FIG. 5 is a block diagram illustrating a functional configuration example of a controller of the inkjet recording device.

Next, a functional configuration of the controller 40 of the inkjet recording device is described. FIG. 5 is a block diagram illustrating a functional configuration example of the controller 40. The controller 60 of the terminal device 2 has a similar configuration. The controller 40 is provided with an image data obtaining unit 71, a region setting unit 72, an ink adhesion amount difference calculator 73, an ink adhesion amount difference determiner 74, an output processor 75, a wrinkle avoidance processor 76, a head position adjuster 77, and a threshold storage 78.

The image data obtaining unit 71 obtains the image data and output setting from the received print job. From this output setting, the type of recording material used for image formation is obtained. Also, an image forming region and a margin region of the recording material are obtained.

The region setting unit 72 detects the ink adhesion amount per unit area (for example, per pixel) in the image forming region and the margin region of the recording material from the image data. Then, a plurality of target regions which become comparison targets of the ink adhesion amount is set. For example, a range in which pixels in which the ink adhesion amount is at a similar level are continuous is set as one target region (same density region). In this manner, by setting a continuous range in which the ink adhesion amount is at a similar level as the target region (same density region), a predetermined target region (same density region) is set in the image forming region. Alternatively, a plurality of target regions (unit area regions) is set in the image forming region by setting the target region (unit area region) for each arbitrary unit area in the image forming region.

In a case where the image is not formed in the margin region, an entire margin region may be set as one target region (same density region), or the margin region may be divided into unit areas to be set as the target region (unit area region). In a case of allowing the ink to adhere to the margin region so as form the image or the like, an ink adhering portion may be set as the target region (same density region) for each ink adhesion amount, or the ink adhering portion may be set as the target region for each unit area (unit area region).

Furthermore, the region setting unit 72 calculates the area of each set target region and determines whether the area is equal to or larger than a predetermined value. In a case where the target region (same density region) is set for each ink adhesion amount, the area of each target region is calculated. In a case where the target region (same density region) is set for each ink adhesion amount, the region setting unit 72 excludes a region in which the area in which the ink adheres is small such as a line image such as a character and a target region in which the ink does not adhere of an area smaller than a predetermined value formed in the ink adhering region (ink free region) from a predetermined target. As a result, only the target region having a predetermined area or larger area is extracted.

In a case where the target region (unit area region) is set for each unit area, the region setting unit 72 obtains the set unit area as the area of the target region.

The ink adhesion amount difference calculator 73 obtains the ink adhesion amount in each target region set by the region setting unit 72, and calculates the difference in the ink adhesion amount between the target regions adjacent to each other (hereinafter referred to as adjacent target regions). The ink adhesion amount difference calculator 73 calculates an average value of the ink adhesion amount in each target region, and sets the average ink adhesion amount as the ink adhesion amount in the target region. The ink adhesion amount may also be calculated based on printing density in the image data.

In the margin region also, the average ink adhesion amount is calculated in a manner similar to that in the image forming region, and this average ink adhesion amount is set as the ink adhesion amount in the margin region. In the margin region, in a case where the image is not formed, the ink adhesion amount in all the target region becomes zero. In a case where the image and the like is formed in the margin region, the average ink adhesion amount of the target region (same density region) for each ink adhesion amount or the target region (unit area region) for each unit area is calculated, and the ink adhesion amount in each target region is obtained. Then, the difference in the ink adhesion amount between the target region and the adjacent target region is calculated from the calculated ink adhesion amount. At that time, the difference in the ink adhesion amount between each target region set on an end of the image forming region and each target region set in the margin region is also calculated.

The ink adhesion amount difference determiner 74 compares the difference in the ink adhesion amount between the target region and the adjacent target region calculated by the ink adhesion amount difference calculator 73 with a predetermined threshold stored in the threshold storage 78 which satisfies the wrinkle occurrence condition to determine whether this exceeds the threshold.

In the threshold storage 78, an arbitrary threshold which satisfies the wrinkle occurrence condition set according to various conditions such as the difference in the ink adhesion amount, the area of the target region, the type of the recording material, the environmental humidity, a grain direction of the recording material, and the position of the target region is set.

The ink adhesion amount difference determiner 74 reads the threshold corresponding to various conditions stored in the threshold storage 78, and compares the read threshold with the ink adhesion amount difference between the adjacent target regions. The thresholds corresponding to the various conditions is to be described later.

Based on a determination result of the ink adhesion amount difference determiner 74, the output processor 75 displays a warning that a wrinkle might occur on the operation display 52. For example, this selectively discloses a responding method such as interruption of printing, avoidance of the occurrence of the wrinkle by reducing the printing density (ink adhesion amount), and adjustment of the distance from the image forming drum 21 to the inkjet head 242 (refer to FIG. 1) to the user.

The wrinkle avoidance processor 76 resets the print job condition to a condition to avoid the wrinkle based on the determination result of the ink adhesion amount difference determiner 74. For example, the ink adhesion amount is adjusted to adjust such that the difference in the ink adhesion amount between the adjacent target regions is reduced. At that time, the changed condition may be displayed on the operation display 52.

The head position adjuster 77 drives the head unit 24 to adjust the position of the inkjet head 242 (refer to FIG. 1) based on the determination result of the ink adhesion amount difference determiner 74, and increases a distance from the image forming drum 21 to the inkjet head 242 such that the inkjet head 242 does not come into contact with the recording material P. As a result, also in a case where a gap between the inkjet head 242 and the image forming drum 21 is increased and the wrinkle occurs, the contact between the recording material P and the inkjet head 242 (so-called head attack) is avoided, and occurrence of image formation defect is suppressed and the inkjet head 242 is protected.

Various conditions affecting the threshold which satisfies the wrinkle occurrence condition in the ink adhesion amount difference determiner 74 is described.

Difference in Ink Adhesion Amount

Figure 6:
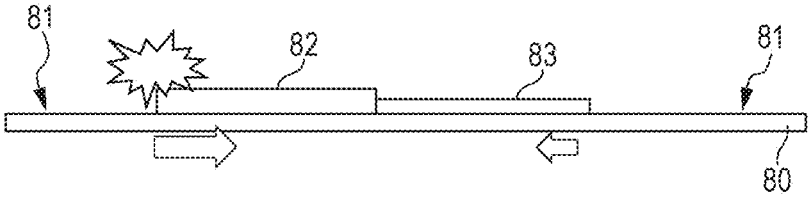
FIG. 6 is a view for explaining occurrence of a wrinkle due to a difference in ink adhesion amount.

As illustrated in FIG. 6, in the image formation, after the ink is adhered to the recording material 80, the ink is cured by ultraviolet irradiation or the like to fix the image. At that time, the ink adhered to the recording material 80 is cured, so that the ink contracts. As the ink contracts, a stress in a contracting direction is also generated in the recording material 80. Note that, in the drawings, the generated stress is indicated by an arrow, and a size of the arrow indicates magnitude of the stress. In the recording material 80, no stress is generated in a target region (ink free region) 81 where the ink does not adhere.

In a target region (hereinafter, high density region) 82 having a large ink adhesion amount, an ink contraction amount is larger than in a target region (hereinafter, low density region) 83 having a small ink adhesion amount. The stress generated in the recording material 80 is also larger on a high density region 82 side and smaller on a low density region 83 side. Therefore, in the high density region 82, the low density region 83, and the ink free region 81, there is a difference in stress generated in the recording material 80 between the adjacent target regions. At that time, the wrinkle is likely to occur from an end of the target region where the stress is small toward the center of the target region where the stress is large at a boundary between the target regions where the difference in the generated stress is large between the adjacent target regions. In a configuration illustrated in FIG. 6, since the difference in stress between the high density region 82 and the ink free region 81 is the largest, the wrinkle is likely to occur from the ink free region 81 toward the center of the high density region 82. On the other hand, at the boundary between the high density region 82 and the low density region 83 or at the boundary between the low density region 83 and the ink free region 81, the difference in stress is small, so that the wrinkle hardly occurs.

In this manner, the larger the difference in the ink adhesion amount between the adjacent target regions, the more easily the wrinkle occurs, and the smaller the difference in the ink adhesion amount, the less easily the wrinkle occurs. Therefore, the threshold which satisfies the wrinkle occurrence condition may be set based on the difference in the ink adhesion amount between the adjacent target regions. In a case where the difference in the ink adhesion amount exceeds the threshold, it is possible to determine that the wrinkle occurrence condition is satisfied.

Area of Target Region

The stress generated by cure shrinkage of the ink changes according to the size of the area of the target region. When the ink adhesion amount is in the same condition, the stress generated by the cure shrinkage of the ink increases as the area of the target region and the adjacent target region increases. That is, the larger the area of the adjacent target regions, the more easily the wrinkle occurs from the boundary of the target regions.

Figure 7:
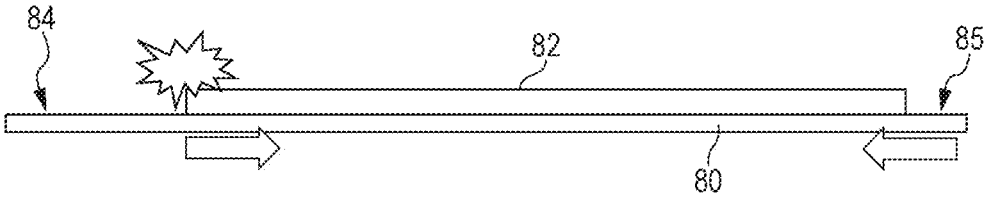
FIG. 7 is a view for explaining an influence of an area of adjacent target region on the occurrence of the wrinkle.

As illustrated in FIG. 7, on the recording material 80, the stress (indicated by an arrow in the drawing) due to the cure shrinkage of the ink in the high density region 82 is substantially the same on the boundaries of the two ink free regions 84 and 85 in contact with the high density region 82. Therefore, when only a stress difference generated due to the cure shrinkage of the ink is taken into consideration, the stress difference generated at the boundaries between the high density region 82 and the ink free regions 84 and 85 are at a similar level.

Figure 8A:
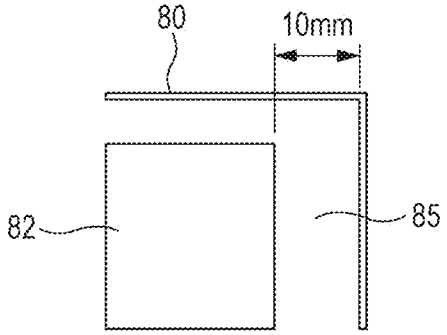
FIG. 8A to FIG. 8C are views for explaining an influence of the area of the adjacent target region on the occurrence of the wrinkle.
Figure 8B:
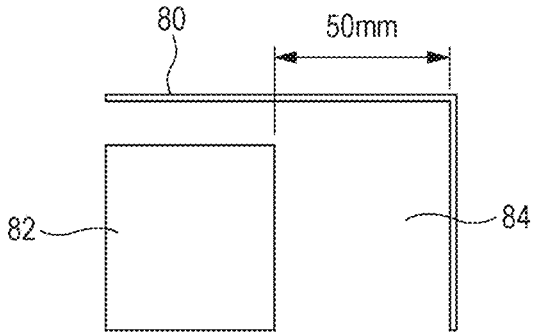
Figure 8C:
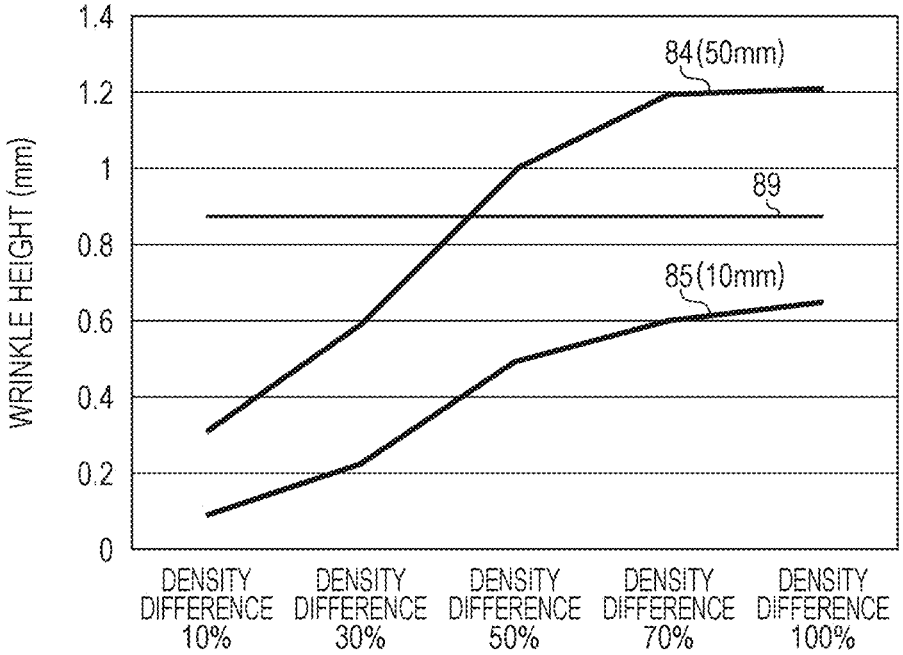

However, since the areas of the ink free regions 84 and 85 are different from each other, magnitude of force repelling the stress generated as the ink in the high density region 82 is cured is different. In FIG. 8A to FIG. 8C, in the recording material 80 in which the high density region 82 is formed to the end of the image forming region, FIG. 8A illustrates a case where the ink free region 85 is set to 10 mm from the end, and FIG. 8B illustrates a case where the ink free region 84 is set to 50 mm from the end. In addition, FIG. 8C is a graph illustrating a wrinkle occurrence condition in a case where the ink free region 85 is set to 10 mm and the ink free region 84 is set to 50 mm. As illustrated in FIG. 8C, the occurring wrinkle is higher in the ink free region 84 having a larger area than in the ink free region 85 having a smaller area.

As described above, the ink free region 84 having the larger area has the larger force repelling the stress due to the cure shrinkage of the ink in the high density region 82, and the ink free region 85 has the smaller force repelling the stress due to the cure shrinkage. Between the adjacent target regions, as the force repelling the occurring cure shrinkage increases, the wrinkle is more likely to occur as in the case where the stress difference increases. Therefore, in the configuration illustrated in FIG. 7, the wrinkle is likely to occur from the ink free region 85 toward the center of the high density region 82. In this manner, as the area of the target region on the low density side decreases with respect to the area of the target region on the high density side, the force repelling the ink cure shrinkage decreases, so that the occurrence of the wrinkle is suppressed as a result.

As described above, likelihood of occurrence of the wrinkle changes according to the size of the target region. Therefore, the ink adhesion amount difference determiner 74 sets the threshold which satisfies the wrinkle occurrence condition according to the size of the areas of the target region and the adjacent target region.

Type of Recording Material

The stress associated with the ink curing is more easily generated in a medium which easily absorbs the ink. Therefore, paper having a resin coating layer on a paper surface such as coated paper tends to have a smaller stress associated with the ink curing than paper having paper fibers exposed on the paper surface such as high-quality paper. Therefore, the wrinkle tends to more easily occur in the high-quality paper than in the coated paper. In addition, a flexible recording material such as cloth is more likely to relax and absorb the stress associated with the ink curing as compared with a hard recording material such as paper. Therefore, the wrinkle is less likely to occur in cloth and the like than paper.

Figure 9:
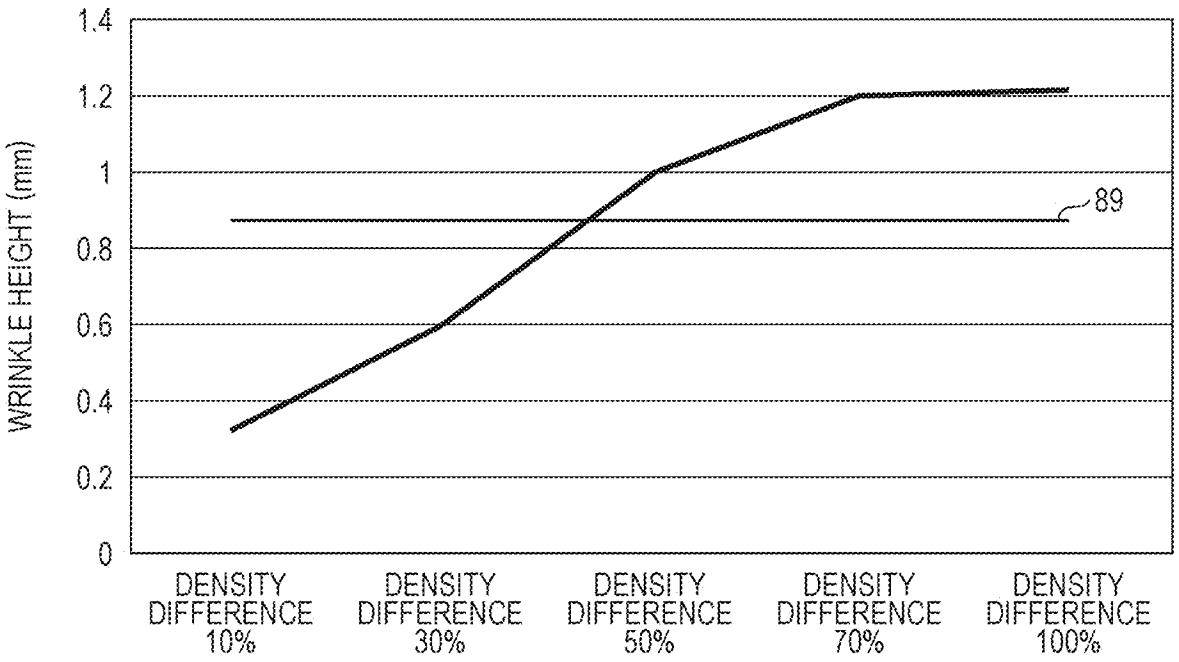
FIG. 9 is a view for explaining an influence of a type of paper on the occurrence of the wrinkle.
Figure 10:
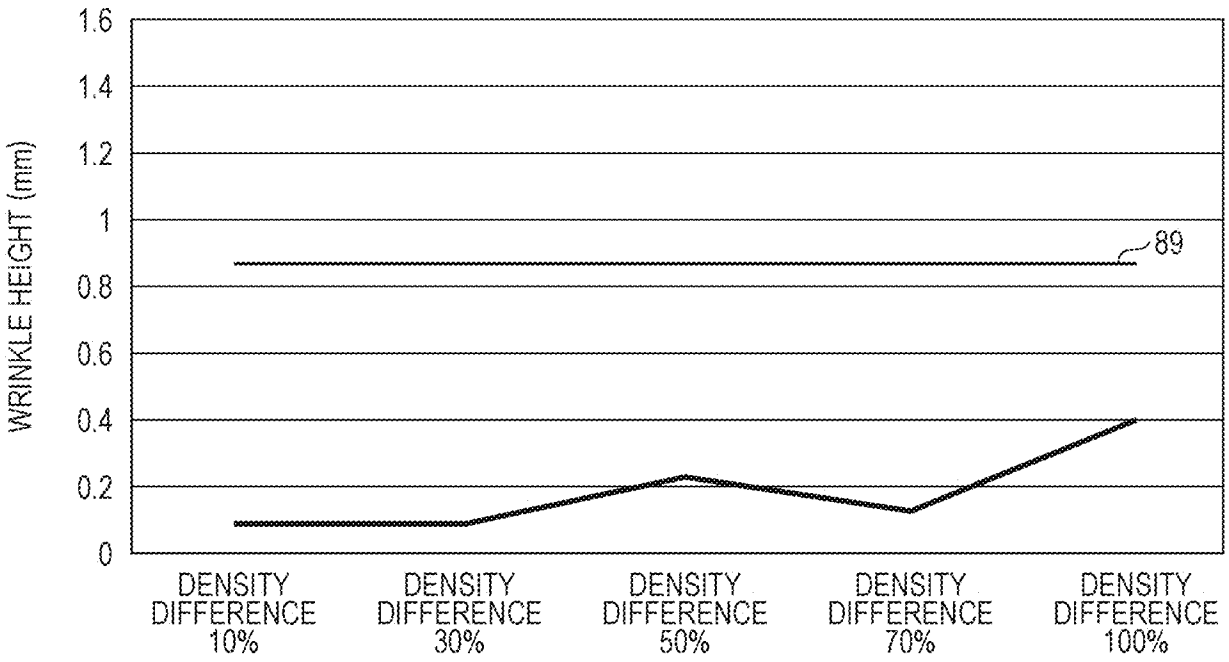
FIG. 10 is a view for explaining an influence of the type of paper on the occurrence of the wrinkle.

FIG. 9 is a graph illustrating a wrinkle occurrence condition in a case where the high-quality paper is used. FIG. 10 is a graph illustrating a wrinkle occurrence condition in a case where the coated paper is used. In the graphs in FIG. 9 and FIG. 10, a height [mm] of the wrinkle occurring on the recording material is plotted along the ordinate, and the difference in the ink adhesion amount between the adjacent target regions [ink adhesion amount difference %] is plotted along the abscissa. A solid line 89 indicates an upper limit (0.9 mm) of the wrinkle height allowed for the recording material in order to prevent the contact (head attack) between the recording material and the inkjet head 242 (refer to FIG. 1) due to the occurrence of the wrinkle.

FIG. 11 is a table illustrating the ink adhesion amount (printing rate %) between the target region and the adjacent target region and the height of wrinkle (mm) occurring between the adjacent regions with the ink adhesion amount (printing rate %) in a case where the high-quality paper is used. FIG. 12 is a table illustrating the ink adhesion amount (printing rate %) between the target region and the adjacent target region and the height of wrinkle (mm) occurring between the adjacent regions with the ink adhesion amount (printing rate %) in a case where the coated paper is used.

In both the high-quality paper and coated paper, there is a tendency that the height of the occurring wrinkle increases as the difference in the ink adhesion amount between the adjacent target regions increases. In all the differences in ink adhesion amount, the height of the wrinkle is higher in the high-quality paper than in the coated paper. Especially, when the difference in the ink adhesion amount is more than 50%, the height of the wrinkle exceeds the head position in the high-quality paper, so that the recording material comes into contact with the inkjet head.

In this manner, the likelihood of the occurrence of the wrinkle changes depending on the type of the recording material. Therefore, it is desirable that the ink adhesion amount difference determiner 74 sets the threshold which satisfies the wrinkle occurrence condition according to the type of recording material.

Environmental Humidity

The higher the humidity in the environment, the more easily the wrinkle occurs on the recording material. Therefore, it is necessary to measure the humidity by the humidity measuring unit 29 provided in the inkjet recording device 1 and to lower the threshold which satisfies the wrinkle occurrence condition in a case where the humidity in the environment is high. Therefore, the ink adhesion amount difference determiner 74 sets the threshold which satisfies the wrinkle occurrence condition according to the humidity in the environment.

Grain Direction of Recording Material

On the recording material, the wrinkle in a direction parallel to a grain direction is likely to occur. Therefore, in a case where a direction of the boundary between the adjacent target regions is a direction orthogonal to the grain direction of the recording material, the wrinkle is likely to occur in the direction parallel to the grain direction of the recording material. That is, the closer the direction of the boundary between the adjacent target regions to the direction parallel to the direction orthogonal to the grain direction of the recording material, the more easily the wrinkle in the direction parallel to the grain direction of the recording material occurs. Therefore, the ink adhesion amount difference determiner 74 sets the threshold which satisfies the wrinkle occurrence condition according to the direction of the boundary between the adjacent target regions and the grain direction of the recording material.

Position of Target Region

On the recording material, the closer to the end of the recording material, the more easily the wrinkle occurs. For example, the wrinkle is likely to occur in the target region near an edge of the recording material, and the wrinkle is less likely to occur in the target region near the center of the recording material. Especially, on the recording material, the wrinkle is most likely to occur at the boundary between the image forming region and the margin region. Therefore, the wrinkle is especially likely to occur in a case where the boundary between the adjacent target regions is between the image forming region and the margin region. Therefore, the ink adhesion amount difference determiner 74 lowers the threshold in the target region near the edge of the recording material and increases the threshold in the target region near the center of the recording material. For example, the threshold which satisfies the wrinkle occurrence condition is set according to a distance between the boundary between the adjacent target regions and the margin region. In a case where the boundary between the target regions is the boundary between the image forming region and the margin region, the threshold is set higher than that in a case where the boundary between the target regions is not the boundary between the image forming region and the margin region.

Procedure of Image Determining Process

Figure 13:
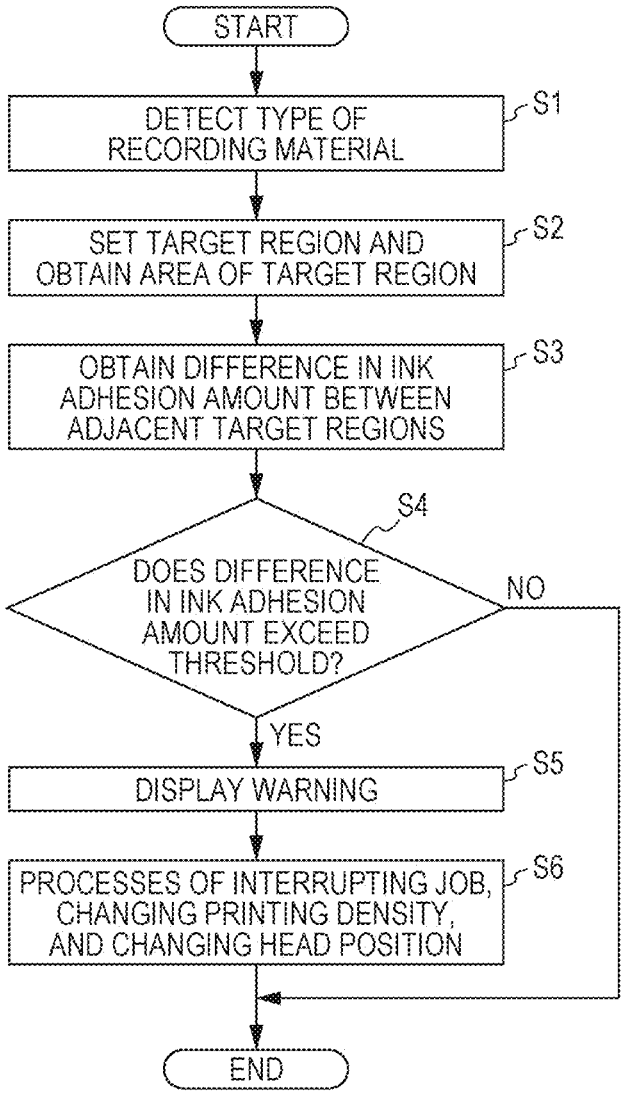
FIG. 13 is a flowchart for explaining a procedure of an image determining process.

Next, an image determining process in the inkjet recording device and the terminal device is described. FIG. 13 is a flowchart for explaining a procedure of the image determining process. The process of this flowchart is realized by the CPU of each device executing the program stored in the ROM.

The image data obtaining unit 71 of the controller 40 obtains the print job and detects the type of the recording material P to be used (step S1). At that time, the type of the recording material used for image formation may be obtained from the output setting of the print job. The image forming region and the margin region of the recording material may also be obtained.

Next, the region setting unit 72 of the controller 40 sets the target region from the image data, and obtains the area of the set target region (step S2). The controller sets a continuous range in which the ink adhesion amount per unit area is at a similar level as one target region in the image forming region and the margin region. Alternatively, the controller sets the target region for each arbitrary unit area in the image forming region and the margin region. Then, the controller calculates the area of the set target region.

Next, the ink adhesion amount difference calculator 73 of the controller 40 obtains the difference in the ink adhesion amount between the adjacent target regions (step S3). The controller calculates the average ink adhesion amount in each set target region and obtains the ink adhesion amount of the target region. The controller obtains the difference in the ink adhesion amount between each target region and the adjacent target region from the calculated ink adhesion amount of each target region.

Next, the ink adhesion amount difference determiner 74 of the controller 40 determines whether the difference in the ink adhesion amount between the adjacent target regions exceeds a predetermined threshold which satisfies the wrinkle occurrence condition (step S4). The controller compares the difference in the ink adhesion amount from the adjacent target region with the predetermined threshold in each obtained target region, and determines whether this is the difference in the ink adhesion amount which satisfies the winkle occurrence condition. The threshold which satisfies the wrinkle occurrence condition is arbitrarily set according to various conditions such as the difference in the ink adhesion amount, the area of the target region, the type of the recording material, the environmental humidity, the grain direction of the recording material, and the position of the target region. In a case where the difference in the ink adhesion amount between the target region and the adjacent target region does not exceed the predetermined threshold which satisfies the wrinkle occurrence condition (NO at step S4), the image determining process by this flowchart ends.

In a case where the difference in the ink adhesion amount between the adjacent target regions exceeds the predetermined threshold which satisfies the wrinkle occurrence condition (YES at step S4), the output processor 75 of the controller 40 displays a warning on the operation display (step S5). For example, the output processor 75 of the controller 40 displays the warning that the wrinkle occurs on the operation display and displays a responding method such as interruption of condition printing, avoidance of the occurrence of the wrinkle by reducing the printing density (ink adhesion amount), and adjustment of the distance from the image forming drum 21 to the inkjet head 242 on the operation display, thereby selectively disclosing the same to the user.

In addition, the wrinkle avoidance processor 76 of the controller 40 performs a user instruction or optionally a responding process in accordance with the above-described determination. For example, the wrinkle avoidance processor 76 of the controller 40 performs the responding process such as automatically stopping the image formation and interrupting the job, changing the printing density so as to realize the ink adhesion amount difference which does not cause the wrinkle, and adjusting the position of the inkjet head 242 (step S6). The wrinkle avoidance processor 76 of the controller 40 performs the processes to suppress the occurrence of the image formation defect and protect the inkjet head.

By performing the above-described image determining process, it is possible to predict the occurrence of the wrinkle due to the difference in the ink adhesion amount between the adjacent target regions before the image formation. Therefore, the occurrence of the wrinkle may be avoided by changing the type of the recording material and the various printing conditions. By predicting the occurrence of the wrinkle, it is possible to avoid the contact between the recording material and the inkjet head (so-called head attack), to suppress the occurrence of image formation defect, and to protect the inkjet head.

Although embodiments of the present invention have been described and illustrated in detail, the disclosed embodiments are made for purposes of illustration and example only and not limitation, and various modifications and changes may be made without departing from the configuration of the present invention. The scope of the present invention should be interpreted by terms of the appended claims.

What is claimed is:

1. An inkjet recording device comprising:

an inkjet head that includes a nozzle for discharging ink on a recording material, and forms an image by discharging the ink from the nozzle on the recording material based on image data; and a hardware processor that performs image processing of the image data, wherein the hardware processor calculates a difference in ink adhesion amount between a target region and an adjacent target region adjacent to the target region in the image data, determines whether the difference in the ink adhesion amount exceeds a threshold based on a calculation result of the hardware processor, and performs a responding process for occurrence of a wrinkle on the recording material based on a determination result of the hardware processor;

wherein the responding process includes reducing a printing density of the image data such that the difference in the ink adhesion amount does not exceed the threshold in a case where the hardware processor determines that the difference in the ink adhesion amount exceeds the threshold.

2. The inkjet recording device according to claim 1, wherein the hardware processor displays notification of possibility of the occurrence of the wrinkle on a display in a case where the hardware processor determines that the difference in the ink adhesion amount exceeds the threshold.

3. The inkjet recording device according to claim 2, wherein the hardware processor interrupts image formation after displaying the notification.

4. The inkjet recording device according to claim 1, wherein the hardware processor moves a position of the inkjet head, and in a case where the hardware processor determines that the difference in the ink adhesion amount exceeds the threshold, the hardware processor adjusts an interval between the inkjet head and the recording material.

5. The inkjet recording device according to claim 1, wherein the hardware processor sets the target region in the image data, and the hardware processor obtains the target region based on the ink adhesion amount for each pixel of the image data.

6. The inkjet recording device according to claim 1, wherein the hardware processor sets the target region in the image data, and the hardware processor sets the target region for each predetermined unit area.

7. The inkjet recording device according to claim 6, wherein the hardware processor makes an average value of the ink adhesion amount in the predetermined unit area the ink adhesion amount of the target region.

8. The inkjet recording device according to claim 1, wherein the hardware processor lowers the threshold of the difference in the ink adhesion amount than the threshold in the target region close to the center of the recording material in the target region close to an edge of the recording material.

9. The inkjet recording device according to claim 1, wherein the hardware processor changes the threshold according to any one or more conditions out of a type of the recording material, environmental humidity, and a length in a direction parallel to a grain direction of the recording material of the target region.

10. The inkjet recording device according to claim 1, wherein the inkjet recording device calculates the ink adhesion amount based on density in the image data.

* * * * *